US010208463B2

(12) United States Patent
Zheng et al.

(10) Patent No.: US 10,208,463 B2
(45) Date of Patent: Feb. 19, 2019

(54) WATER WELL CASE HEAD ADAPTER

(71) Applicants: Wanying Zheng, Oklahoma City, OK (US); Madison Kay Enright, Edmond, OK (US); Nicholas D Blankenship, Edmond, OK (US)

(72) Inventors: Wanying Zheng, Oklahoma City, OK (US); Madison Kay Enright, Edmond, OK (US); Nicholas D Blankenship, Edmond, OK (US)

( * ) Notice: Subject to any disclaimer, the term of this patent is extended or adjusted under 35 U.S.C. 154(b) by 0 days.

(21) Appl. No.: 15/731,274

(22) Filed: May 16, 2017

(65) Prior Publication Data

US 2018/0334785 A1 Nov. 22, 2018

(51) Int. Cl.
*E21B 33/04* (2006.01)
*E03B 3/06* (2006.01)
*E03B 5/06* (2006.01)

(52) U.S. Cl.
CPC ..... *E03B 5/06* (2013.01); *E03B 3/06* (2013.01); *E21B 33/04* (2013.01)

(58) Field of Classification Search
CPC ..... E21B 33/04; E03B 3/06; E03B 5/06
See application file for complete search history.

(56) References Cited

U.S. PATENT DOCUMENTS 2,287,432 A 6/1942 Kinzbach
2,587,474 A * 2/1952 Howard ..... E21B 33/04 277/510
3,249,371 A 5/1966 Peterman
3,393,740 A * 7/1968 Seese ..... E21B 33/04 166/93.1
3,477,106 A 11/1969 Tetzlaff
3,675,719 A * 7/1972 Slator ..... E21B 33/04 166/297
4,151,864 A 5/1979 Thurman
4,291,767 A * 9/1981 Hall, Jr. ..... E21B 33/14 166/243
4,450,905 A * 5/1984 Crain ..... E21B 21/01 166/81.1
4,895,205 A * 1/1990 Thompson ..... E21B 17/006 166/311
5,323,854 A * 6/1994 Pursley, Jr. ..... E21B 33/0422 166/75.13
5,327,862 A 7/1994 Bedi
5,358,012 A 10/1994 Kish
6,702,332 B2 3/2004 Young
8,905,150 B1 * 12/2014 Pruitt ..... E21B 33/085 166/387
9,784,065 B2 * 10/2017 Holtby ..... E21B 33/08
(Continued)

*Primary Examiner* — Matthew R Buck
(74) *Attorney, Agent, or Firm* — Randal D. Homburg

(57) ABSTRACT

A water well head casing adapter for attachment to a water well head casing providing a two piece body engaged within the head casing of the water well with an inner formed cavity securing a baffle comprising a plurality of flexible wafer inserts defining a linear bore, the linear bore forming a seal around an air pressure hose to introduce pressurized air into the water well casing without water or air escaping between the air hose and the linear bore, the water well head casing adapter used to reduce the time and improve the efficiency required to purge and to blow out unsanitary water in the water well casing and water lines of a newly drilled water well.

7 Claims, 4 Drawing Sheets

(56) References Cited

U.S. PATENT DOCUMENTS

2002/0179300 A1* 12/2002 Gay ..... E21B 33/08
166/81.1
2011/0108278 A1* 5/2011 Holtby ..... E21B 17/006
166/311

* cited by examiner

WATER WELL CASE HEAD ADAPTER

I. BACKGROUND OF THE INVENTION

1. Field of Invention

A water well head casing adapter for attachment to a water well head casing providing a two piece body engaged within the head casing of the water well with an inner formed cavity securing a baffle comprising a plurality of flexible wafer inserts defining a linear bore, the linear bore forming a seal around an air pressure hose to introduce pressurized air into the water well casing without water or air escaping between the air hose and the linear bore, the water well head casing adapter used to reduce the time and improve the efficiency required to purge and to blow out unsanitary water in the water well casing and water lines of a newly drilled water well.

2. Description of Prior Art

A preliminary review of prior art patents was conducted by the applicant which reveal prior art patents in a similar field or having similar use. However, the prior art inventions do not disclose the same or similar elements as the present water well casing adapter, nor do they present the material components in a manner contemplated or anticipated in the prior art.

Primarily, the prior art disclosed numerous devices for connecting a hose to a fitting or connecting hoses together. In U.S. Pat. No. 6,702,332 to Young, an adapter is shown to connect a hose to a hose receptacle or an object in a locking relationship. It is not intended for a well head casing, nor does it provide a secure reduction channel accepting an air hose without air loss. A multiple port filter is shown in U.S. Pat. No. 5,327,862 to Bedi, but it is used on an engine filter for oil filtration and facilitates engine cleaning and oil changing. It cannot adapt to a water well casing or accept the introduction of an air hose without air loss. Three U.S. Pat. No. 4,151,864 to Thurman, U.S. Pat. No. 3,477,106 to Tetzlaff, and U.S. Pat. No. 3,249,371 to Peterman deal with laundry hose connections and adapters for fluid flow. A pipe holding slip to secure to a pipe for lifting, probably useful in grabbing the casing during the setting process, is shown in U.S. Pat. No. 2,287,432 to Kinzback.

II. SUMMARY OF THE INVENTION

Water wells, especially those in third world countries, are essential to provide clean drinkable water and to eliminate the consumption requirement and exposure to disease in most surface water consumption situations. Many charitable organizations have intervened to help provide water wells in many countries around the world to address the issue of clean drinking water to these people in order to provide the essential drinking water to improve health and reduce the almost certain risk of contaminated water supplies and biological disease transmission.

Alarming statistics provided by the World Health Organization (WHO) demonstrate that almost 840,000 people die each year due to drinking contaminated water, most from surface water and dirty wells. Ten percent of the people in the world have no clean water access. Over 80% of common diseases in third world countries is caused by poor drinking water and sanitation. The water and sanitation crisis world wide is the second biggest killer of small children under 5 years of age. Poor children around the world miss 443 million days of school each year with water-related illnesses. World wide economic loss due to lack of clean water is estimated at $260 billion dollars.

The present manner which water wells are developed involves the drilling of the well to a depth on the average of 200 feet, the placement of well casing, generally PVC tubing which encroaches below the underground water level, and finally purge the well of unsanitary water which originally fills the casing until the unsanitary water is eliminated and replaced by clean drinkable water. This commonly involves a stepwise elimination of water from the bottom up at several different level of elimination, most commonly at 5 feet intervals, to push the water from below by the introduction of pressurized air to lift the water to the top of the casing and out or a water line extending from the top of the completed casing.

At the present time, this is done by sealing off the top of the casing and running an air hose into the bottom of the casing at the target level, with the top of the casing sealed with whatever is available—generally rags, cloths, or other fabric materials held in place by ties, straps or ropes. The only way this works is if there is a seal around the top of the casing where the air hose enters to prevent air leaks. If there is an air leak, the water will not be lifted to the water line and eliminated. Therefore, the purging process is quite tedious, inefficient and time consuming. It takes approximately 15 minutes at each level just to reposition and retape each level during the purging process.

The present water well casing adapter is a reliable and time reducing device that engages the top of the well casing and provides a flexible baffle through which an air hose is introduced into the bottom of the water well casing which prevents air loss during the purging process, is quickly installed and removed, and does not require reattachment and reengagement every time the air hose is moved up the well during the phasic purging process. It is installed and clamped to the well head casing, with the baffle allowing for intentional movement of the air hose while maintaining an air seal to prevent pressurized air loss. It takes only a matter of seconds, after the initial application of the device to the well head casing to move the air hose from one level to another during the purging process. Overall time saving is approximately 80% or more, allowing water wells to be drilled and purged during a work day, and significantly reduces the number of workers it takes to perform the purging process upon completion of the water well by 33-50%. Using the prior inefficient technique, it took 3-4 people all day (approximately 9 hours) to purge one water well. Using the present water well case head adapter, it takes approximately two hours for 2-3 people to start and complete the purging of the same water well.

III. DESCRIPTION OF THE DRAWINGS

The following drawings are submitted with this utility patent application.

IV. DESCRIPTION OF THE PREFERRED EMBODIMENT

Figure 1:
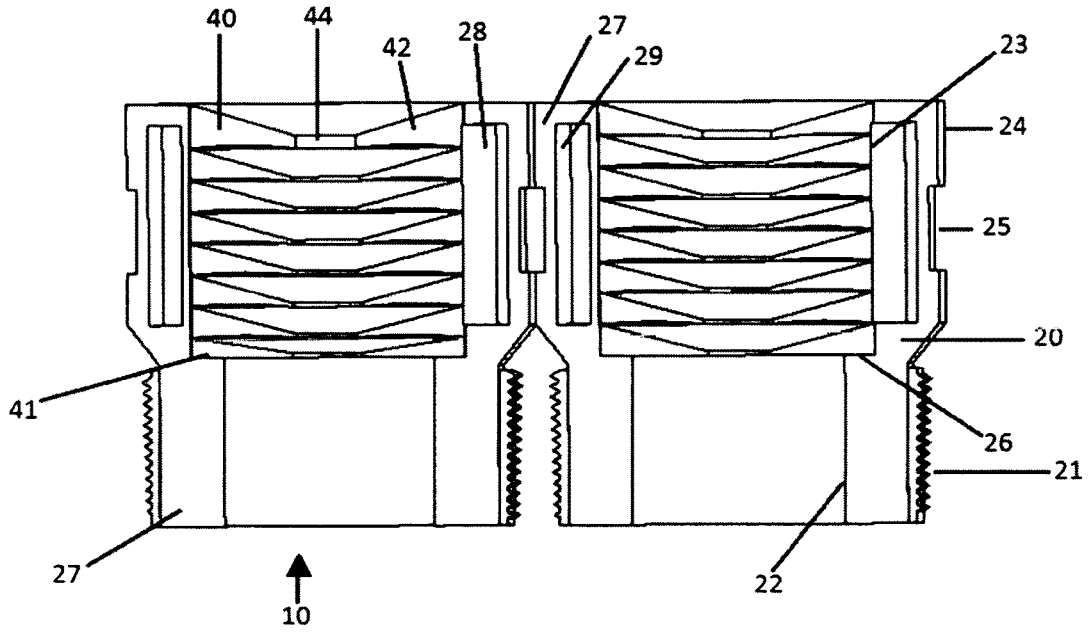
FIG. 1 is an inner view of the water well case head adapter in an open position with the two halves of the adapter attached by a hinge.

A water well case head adapter 10, attaching to a casing head B of a water well casing A, shown in FIG. 1-6 of the drawings, provides an air tight seal within a water well casing A defining a pair of secured half cylindrical bodies 20 containing a pair of half cylindrical baffles 40 containing a linear bore 45, the joined baffles 40 forming by a plurality of flexible wafers 42 which engage and secure a pressurized air hose X with a water and air tight seal introducing air into the well casing A below the water level to purge the water well casing A of unsanitary water prior to use.

Figure 3:
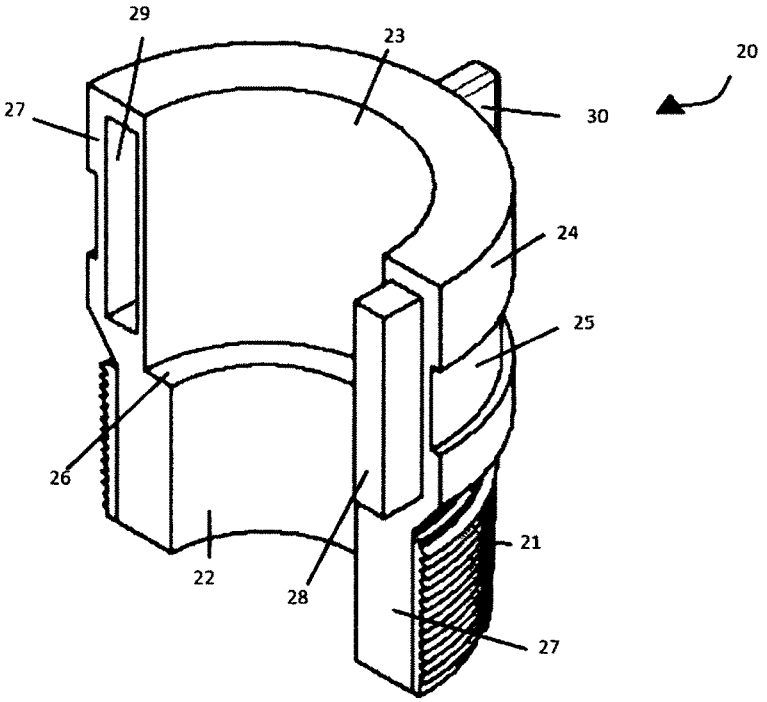
FIG. 3 is a perspective of the one half of the water well case head adapter with the multiple wafer baffle removed.
Figure 4:
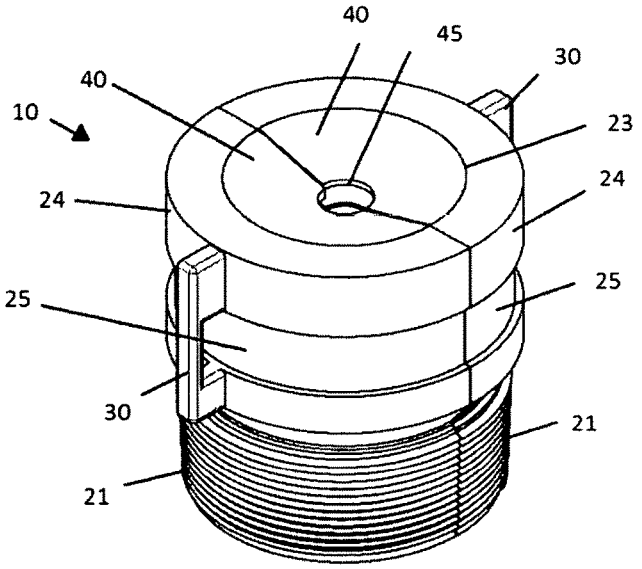
FIG. 4 is an outer view of the water well case head adapter in a closed position.

The water well case adapter 10 defines two identical half cylindrical bodies 20, one of which is shown in FIG. 3, each body defining a lower threaded outer surface 21, a lower smooth inner surface 22, an upper expanded inner cavity 23, and an upper outer surface 24 provided with a clamp recess 25. There are two flat lateral edges 27, one providing an engagement flange 28 and the other providing an engagement recess 29. Each engagement flange 28 and engagement recess 29 of each half cylindrical body 20 will receive and insert the flange 28 of one body within the recess 29 of the other body 20 so that the two half cylindrical bodies 20 form a joined full cylinder as shown in FIG. 4, creating an air tight seal between each respective flat lateral edges 27. There can be handles 30 formed on the upper outer surface 24 spanning the clamp recess 25. Each half cylindrical body 20 is made of a hard non-deformable material, preferably a formed hard plastic, polymer or metal, which will not deform under the pressure of air or water.

Figure 2:
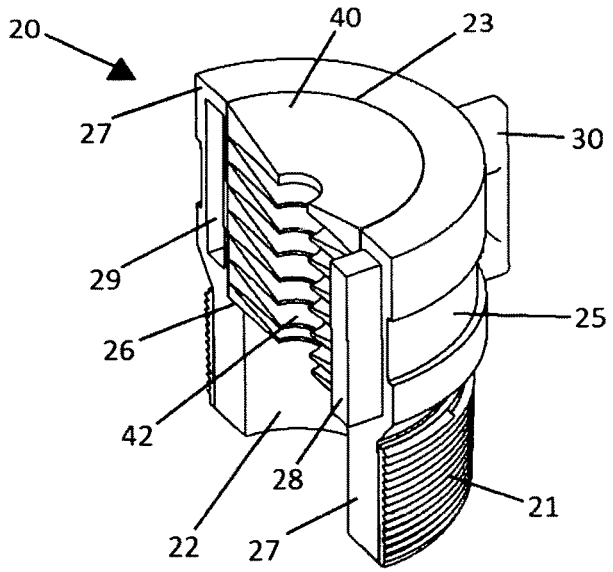
FIG. 2 is an inner view of one half of the water well case head adapter including the multiple wafer baffle.

Within each upper expanded inner cavity 23 is a half cylindrical baffle 40 defining a plurality of flexible wafers 42 in horizontal layers, as shown in FIGS. 1-2. Each half cylindrical baffle 40 is shaped and sized to be fitted securely within each respective upper expanded inner cavity 23 to form an air and water tight seal between the upper expanded inner cavity 23 and each baffle segment 40. There is a lower ridge 26 separating the upper expanded inner cavity 23 from the lower smooth inner surface 22, as indicated in FIG. 3, with the upper expanded inner cavity 23 defining a larger diameter than the lower smooth inner margin. This lower ridge 26 forms a support to a lower surface 41 of each half cylindrical baffle 40 to maintain the vertical position of each half cylindrical baffle 40 within each half cylindrical body 20.

Figure 5:
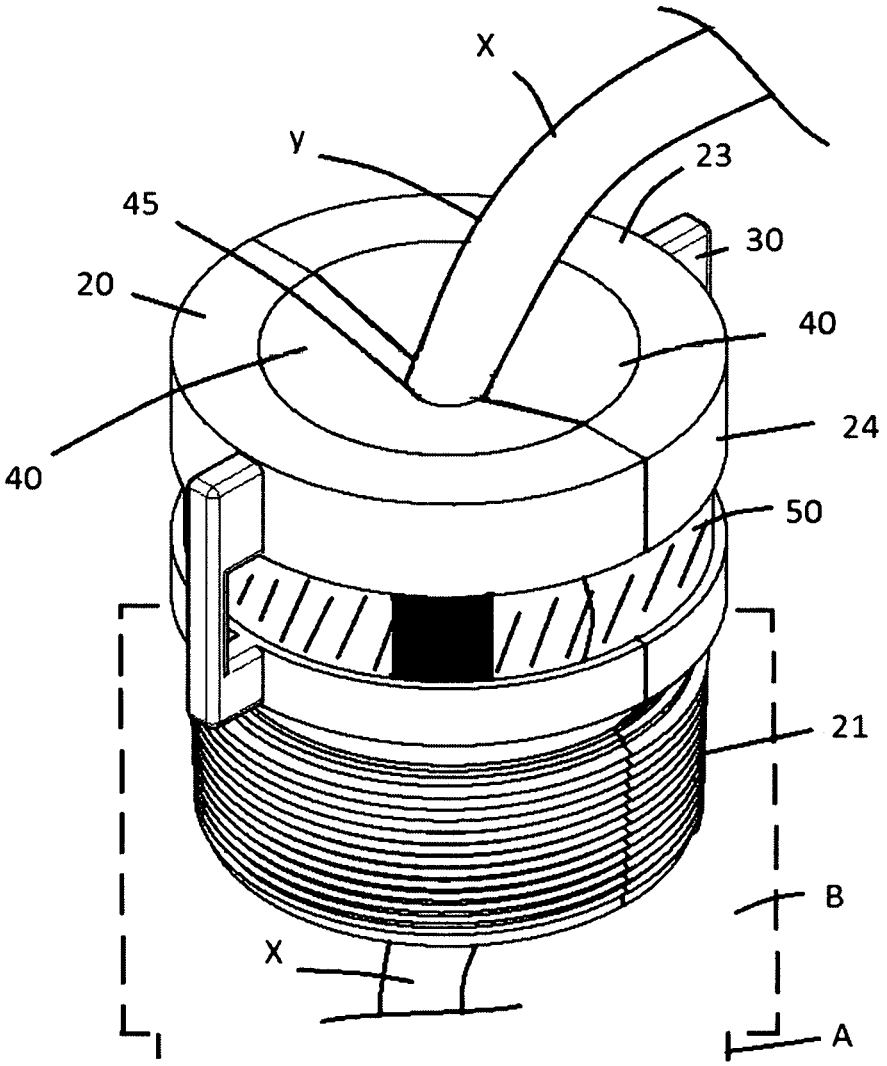
FIG. 5 is a view of the water well case head adapter attached to the casing header with an air hose inserting within the upper baffle channel.
Figure 6:
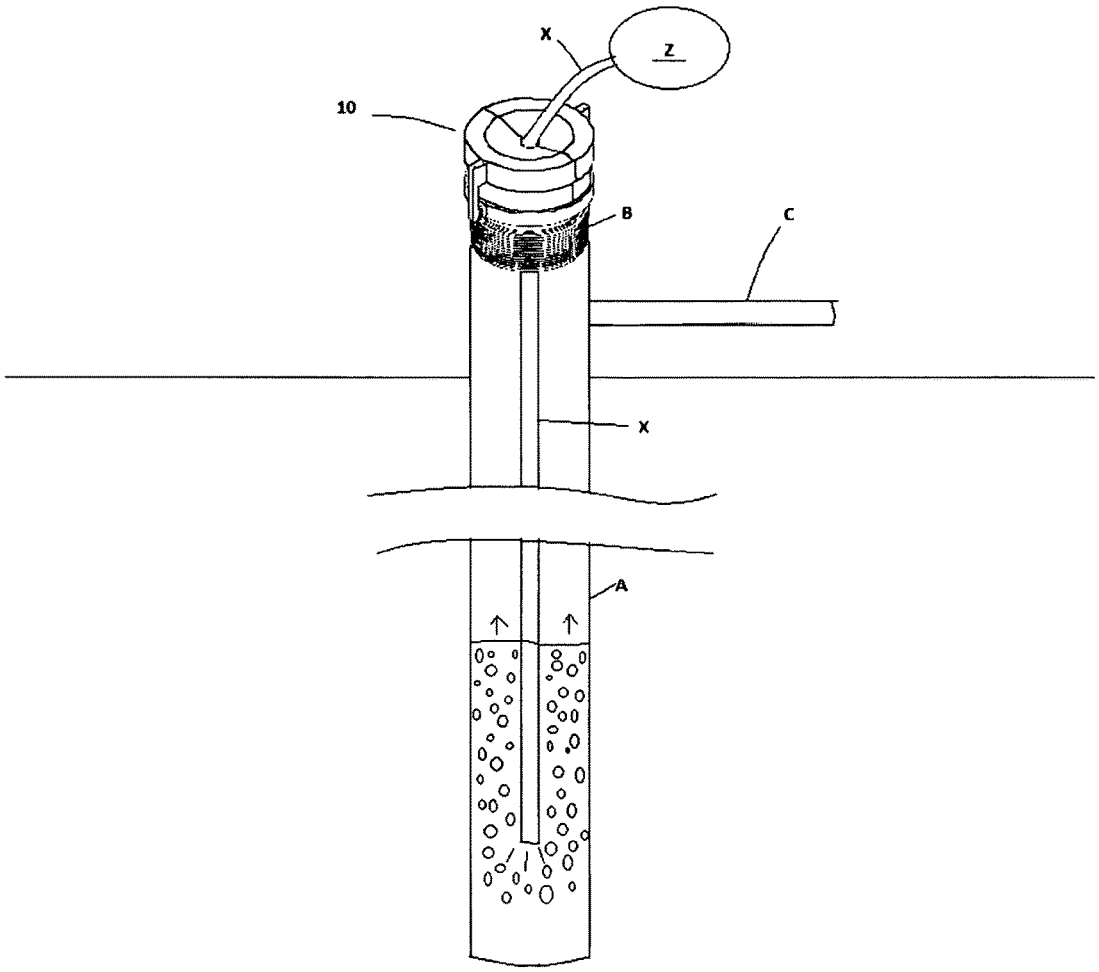
FIG. 6 is an illustration of the water well case adapter attached to the casing head with an air hose inserting through the baffle channel into a well to clear unsanitary water within entire casing during one phase of the water sanitation process.

When each half cylindrical body 20 is united to form the full cylinder of FIGS. 4-6, the half cylindrical baffle segments 40 are also engaged against each other, and will either force each flexible wafer 42 against each other, or offset each flexible wafer 42 in an alternating alignment. Each flexible wafer 42 defines a central half circle notch 44, with each vertically aligned notch 44 forming the linear bore 45 of the combined half cylindrical baffle segments 40. Regardless, the engagement of the flexible wafers 42 within each half cylindrical baffle segments 40, when joined, the linear bore 45 will seal against an outer surface Y of a pressurized air hose X in a manner to form an airtight and water tight seal against the pressurized air hose X. The linear bore 45 may be a straight vertical bore or an offset vertical bore. In the straight vertical bore embodiment, each semicircular notch of each flexible wafer would be directly oriented to the semicircular notch above or below. In the offset vertical bore embodiment, each semicircular notch of each flexible wafer would be offset in orientation to the semicircular notch above or below, most preferably in alternating sequence. The preferable material from which each half cylindrical baffle segments 40 are made was shown during field testing included a shore 60 urethane, which produced a comparatively soft flexible horizontal wafer where lower pressure air was introduced through the pressurized air hose, and a shore 80 rubber, which tended to grip the pressurized air hose better and withstand greater pressure than the half cylindrical baffle segments using the shore 60 urethane product.

In use on a drilled and newly installed water well casing A, the each half cylindrical outer body A containing a respective half cylindrical baffle 40 is joined together, with the engagement flange 28 of one half cylindrical body engaged within the engagement recess 29 of the other, and vice versa. The lower threaded outer surface 21 of the attached half cylindrical bodies 20 is inserted within a female threaded water well casing head B. In the event the water well casing head B did not have inner threads, the lower threaded outer surface 21 of the half cylindrical bodies 20 would be provided without outer threads, but instead some type of gasket seal sleeve or gasket coating, not shown, to create a seal between the well casing and the threadless lower outer surface of the water well casing head adapter 10. See FIGS. 5-6.

A clamp 50 is placed within the clamp recess 25 around the joined half cylindrical bodies 20 to completely seal the water well case head adapter 10 and withstand air and water pressure without separation, as indicated in FIG. 5, with the clamp 50 inserting through the handles 30 where provided. An air hose X attached to an external air compressor Z is inserted through the linear bore 45 of the joined half cylindrical baffles 40. When the air hose X is pressurized, it expands and forms the air and water tight seal between an outer surface Y of the air hose X and joined half cylindrical baffles 40. Once the level or treatment of air for a level of water well casing A has been conducted for approximately 15 minutes, the air is turned off, the adapter 10 is removed from the female threaded casing head B and half cylindrical outer bodies 20 are disengaged by removal of the clamp 50 and separation from one another while the air hose X is raised approximately 5 feet, wherein the process is repeated until the water within the well casing A flows clear and is determined to be sanitary and safe for human consumption In a case example where the water well is 200 feet, the process of attachment and purge would commence at 200 feet and be repeated every 5 feet to a level of approximately 50 feet. With the forced introduction of air into the water of the water well, the water above the air hose is lifted to the top of the casing A and expelled through a water well water outlet tube C, FIG. 6, and is discharged or removed to a location where the water is used to irrigate something local that does not require potable water. It can also be sent to a location where low volume filtration may occur to convert this unsanitary water to clean water.

By reducing the amount of time to engage and disengage the water well case head adapter 10 for each movement of the air hose X within the water well casing A, a time reduction of at least 80% is gained and the efficiency of the air hose injection purging requires less time to complete each level of purging by several hours. This improved efficiency and time savings allows for the development and production of more water wells in less amount of time and with less manpower than attempting to purge the water well using any other known means. Time savings and efficiency can be measured in saved lives, improved health, lower mortality and lower incident of disease among the consumers of the water, especially in third world countries where the provision of clean drinking water is urgent to the pint of becoming a world wide crisis which can easily be addressed by the present water well case head adapter to expedite the time it takes to complete a water well to produce this much needed clean water.

While the water well case head adapter 10 has been particularly shown and described with reference to a preferred embodiment thereof, it will be understood by those skilled in the art that changes in form and detail may be made therein without departing from the spirit and scope of the invention.

What is claimed is:

1. A water well case head adapter attaching to a casing head of a newly installed water well casing further providing an air tight seal to secure a pressurized air hose to purge the water well casing of unsanitary water prior to use for drinking water, said water well case head adapter comprising:

a pair of identical half cylinder bodies, each body defining a lower threaded outer surface, an upper outer surface, a lower smooth inner surface, an upper expanded inner cavity, and a pair of lateral edges;

a clamp recess defined within said upper outer surface providing for the installation of a clamp to join each of said half cylinder bodies together along said lateral edges, said half cylindrical bodies forming a cylinder;

a lower ridge defined between said lower smooth inner surface and said upper expanded inner cavity, wherein said upper expanded inner cavity provides a larger diameter than said lower smooth inner surface;

a pair of half cylinder baffle segments, each said-baffle segment defining a lower surface, a plurality of flexible horizontal wafers, each wafer defining an inner semicircular notch, the notches vertically aligned to form a linear bore when said baffle segments are joined together and securely installed within said upper expanded inner cavity, with said lower surfaces of said joined baffle segments seated upon said lower ridge and forming an air-tight seal against said upper expanded inner cavity and said flexible horizontal wafers pressing against one another forming an airtight seal except for said linear bore, wherein said lower threaded outer surface of said joined half cylinder bodies engage inner threads of said casing head of said water well casing and said air hose is inserted within said linear bore forming an air-tight seal between said baffle segments and an outer surface of said air hose introducing pressurized air from an attached air compressor through said air hose into said well casing, forcing said unsanitary water within said well casing upward at phasic depths to be purged through a water outlet tube within said well casing until such time as said unsanitary water has been evacuated from said well casing with only sanitary water left within said well casing.

2. The water well case head adapter of claim 1, wherein:

each of said half cylinder bodies further defines a handle spanning each of said clamp recesses; and each of said lateral edges of each of said half cylinder bodies defines one lateral edge forming an engagement flange and said other lateral edge defines an engagement recess, wherein said half cylinder bodies are joined together, said engagement flange of each of said half cylinder bodies inserts within said engagement recess of the other, forming a secure sealed attachment.

3. The water well case head adapter of claim 1, wherein:

said linear bore formed by each of said semicircular notches of each of said flexible horizontal wafers of each of said baffle segments form a straight vertical linear bore, with each of said semicircular notches of each of said, adjacent flexible horizontal wafers of each of said baffle segments aligned directly above another.

4. The water well case head adapter of claim 1, wherein:

said linear bore formed by each of said semicircular notches of each of said flexible horizontal wafers within each of said baffle segments form an offset vertical linear bore, with each of said semicircular notches not directly aligned, but offset relative to the next adjacent said semicircular notch of each of said flexible horizontal wafers of said baffle segment.

5. The water well case head adapter of claim 1, wherein:

each of said half cylinder baffle segments is made of shore 60 urethane.

6. The water well case head adapter of claim 1, wherein:

each of said half cylinder baffle segments is made of shore 80 rubber.

7. The water well case head adapter of claim 1, wherein:

each of said half cylinder bodies is made of a hard non-deformable material.

* * * * *